US005550425A

United States Patent [19]

Yoder

[11] Patent Number: 5,550,425

[45] Date of Patent: Aug. 27, 1996

[54] NEGATIVE ELECTRON AFFINITY SPARK PLUG

[75] Inventor: Max N. Yoder, Falls Church, Va.

[73] Assignee: The United States of America as represented by the Secretary of the Navy, Washington, D.C.

[21] Appl. No.: 379,815

[22] Filed: Jan. 27, 1995

[51] Int. Cl.[6] ..... H01T 13/22

[52] U.S. Cl. ..... 313/141; 313/131 A

[58] Field of Search ..... 313/141, 131 A, 313/130, 131 R; 123/169 R, 169 E

[56] References Cited

U.S. PATENT DOCUMENTS

| | | | |
|---|---|---|---|
| 4,144,474 | 3/1979 | Nishio et al. | 313/131 A |
| 4,400,643 | 8/1983 | Nishio et al. | 313/11.5 |
| 4,406,968 | 9/1983 | Friese et al. | 313/136 |
| 4,539,503 | 9/1985 | Esper et al. | 313/11.5 |
| 4,659,960 | 4/1987 | Toya et al. | 313/141 |
| 4,692,657 | 9/1987 | Grunwald et al. | 313/144 |
| 4,910,428 | 3/1990 | Strumbos | 313/141 |

*Primary Examiner*—Sandra L. O'Shea
*Assistant Examiner*—Pip Patel
*Attorney, Agent, or Firm*—Thomas E. McDonald; William F. McCarthy

[57] ABSTRACT

A spark plug having a positive electrode spark tip which is covered with a very thin layer (≦20 nanometers) of very hard NEA material having very large chemical binding energies such that most elements, including carbon and nitrogen, will not bind to its surface. The NEA material may be sapphire, or may be an n-type impurity-doped semiconductor material such as n-type AlN, cBN, or GaAlN having a bandgap exceeding 5.5 eV.

12 Claims, 4 Drawing Sheets

NEGATIVE ELECTRON AFFINITY SPARK PLUG

BACKGROUND OF THE INVENTION

1. Technical Field

The invention relates generally to spark ignition devices, and, in particular, to spark plugs for internal combustion engines.

2. Background Art

The electrodes of a spark plug are typically made of a material that is resistant to oxidization, heat, and burning. Typical material is a nickel alloy steel and a premium material is platinum. Most spark plugs have two electrodes, a center one 16 and a side one 18, as shown in FIGS. 1 and 2. Between the two electrodes is a physical gap and it is in this gap that a spark is created to ignite the gas mixture in the cylinder of an internal combustion engine and in other burners requiring ignition. The center electrode is connected to the most negative source of the ignition coil while the outer electrode is at ground potential. Thus, relative to one another, the center electrode is a negative electrode and the outer electrode is a positive electrode. The reason for this is that the center electrode is at a higher temperature than the outer electrode. As such, it is a much better emitter of electrons than is the cooler electrode.

Spark plug design is currently a compromise situation. The hotter the center tip, the greater the density of emitted electron and the "hotter" the spark. If it is too hot (e.g., is greater than 1700 Fahrenheit), however, its temperature alone will cause the fuel mixture to ignite before the presence of the spark itself. This is an engine-damaging situation known as preignition or "ping". FIG. 1 illustrates a relatively "cold" plug wherein the electrical insulator 10 is comparatively short thus providing a better thermal cooling path to the outer portions of the spark plug that are in direct contact to the engine head 12. The engine head 12 is, in turn, cooled by water 14 flowing through passages in the head. In the relatively "hot" spark plug shown in FIG. 2, the electrical insulator 10' is comparatively long, thus creating more thermal resistance and allowing the spark electrode tip 16 to become hotter. If the tip 16 is too cool, there will not be a high enough electron density in the spark to properly ignite the fuel/air mixture and the spark plug will eventually foul and become inoperative. The plug tip 16 must be hot enough to preclude fouling, but cool enough to prevent preignition. FIG. 3 illustrates the diametrically opposing constraints. This is further complicated in that temperature changes as a function of engine speed and loading. The present generation spark plugs are optimized for normal highway driving, but are less than optimum for city driving and for high speed driving.

Present generation spark plugs typically have a spark gap of 0.040 inches. The gap is also a compromise. The longer the gap, the higher the probability that the spark will properly ignite the fuel/air mixture and the longer the life of the spark plug as the hot tip will burn away faster when the gap is shorter and the current it emits is higher. The shorter the gap, the higher is the probability of the ignition coil causing a spark to jump between the electrodes and fire the fuel/air mixture, but the shorter gap causes the tip to erode or burn away faster, thus shortening its life. In this wear-out mechanism, the hot tip 16 erodes at a rate about 100 times faster than does the cooler outer electrode 18.

In summary, spark plug design today is a compromise. The hotter the tip, the higher is the probability of a spark jumping the gap between the electrodes 16, 18 under all operating conditions, but the shorter is the operating life of the plug. If it is too hot, however, unwanted ping occurs. If it is too cool, the plug will not fire properly and will soon foul out. The shorter the gap, the higher is the probability that a spark will occur under all operating conditions, but the shorter is the operating life of the plug.

Cesium has long been known to exhibit a Negative Electron Affinity (NEA). This is a situation wherein the energy of the vacuum level is below that of the conduction band electrons on the surface. This enables the material to emit electrons—even when cold. Unfortunately, when exposed to virtually any other element of the periodic table (e.g., oxygen, nitrogen, carbon, hydrogen), the cesium surface is poisoned and it no longer emits electrons.

Recently, aluminum nitride (AlN) and cubic boron nitride (cBN) have been shown to exhibit NEA. Unlike cesium, however, these materials are unusually robust and can be exposed to hydrogen, oxygen, nitrogen, and water and still continue to act as electron emitters. Also, AlN and cBN are very hard materials—much harder than nickel steel alloys or platinum. As such, neither AlN or cBN is easily eroded or burned away as is nickel steel.

Although AlN and cBN are usually insulators, both A1N and cBN can be n-type impurity doped if there is no oxygen present during growth. In contrast to cesium where virtually every element in the periodic table will bind to it with a binding energy greater than does cesium bind to itself (and thus poison its surface), the chemical binding energies in A1N or cBN are very large and virtually nothing will bind to its surface. Only oxygen has been shown to do this and then at an extremely low rate.

Over a long period of time, A1N exposed to atomic oxygen will be converted to sapphire, a crystalline form of aluminum oxide, $Al_2O_3$. Fortunately, aluminum oxide is also a NEA material, but it can not be impurity doped and thus has not been used as a cold cathode. Only if the aluminum oxide film is very thin (e.g., less than 20 nanometers) can it be used as a cold cathode electron emitter. The reason for this is that at such thickness, electrons can tunnel through it to the surface where they are emitted into the ambient.

NEA materials will emit electrical current at the same density as does a field emitter, but at an electric field strength of 10,000 times less. Thus much less voltage is required for a given current density when a NEA emitter is used.

SUMMARY OF THE INVENTION

A spark plug, according to the invention, includes a center negative electrode and an outer, positive electrode, which have spark end portions that define a spark path therebetween. The spark end portion of the negative electrode includes an n-type impurity-doped semiconductor material, such as aluminum nitride or boron nitride, which exhibit negative electron affinity (NEA) and which have very large chemical binding energies such that most elements, including carbon and nitrogen, will not readily chemisorb to its surface. The NEA material may be formed as a very thin layer on a metal, electrically conducting, core portion of the center electrode.

In another embodiment of the invention, the NEA material is a layer of sapphire ($Al_2O_3$) which is less than 20 nanometers thick, so that electrons in the underlying electrically conducting core material can tunnel through it to the surface where they are emitted to generate a spark within the combustion chamber.

The invention will be better understood, and various features and advantages will become apparent from the following description of preferred embodiments, taken in conjunction with the drawings.

DESCRIPTION OF THE PREFERRED EMBODIMENTS

Figure 4:
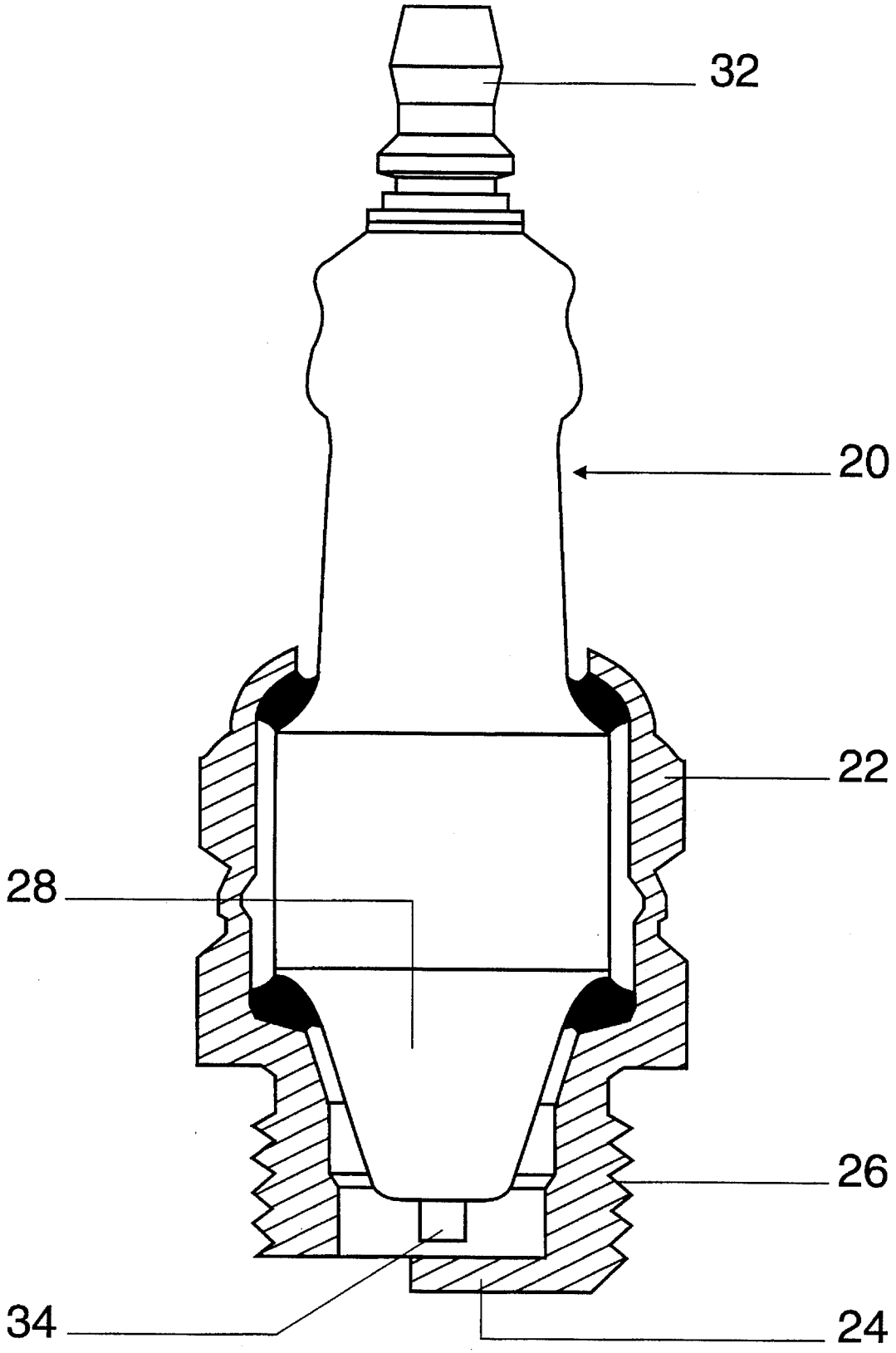
FIG. 4 is a side view, partially in cross-section, of a spark plug, according to the invention.

Referring now to FIG. 4, a spark plug 20 includes a metal housing 22 which is provided with an external or ground electrode 24 and which has a threaded lower end 26 so that the spark plug 20 can be attached to an internal combustion engine. A ceramic insulator 28, which is disposed within and secured to the metal housing 22, has an axial bore 30 through which an electrical conductor(not shown) extends from the spark plug center terminal 32 to the spark electrode tip 34. The insulator 28 can be made much shorter than the insulators of prior spark plugs, since the NEA spark plug 20 can operate successfully at a much lower electrode tip temperature. Also the spark gap between the electrode tip 34 and the ground electrode 24 can be much longer that the spark gap of prior spark plugs.

Figure 2:
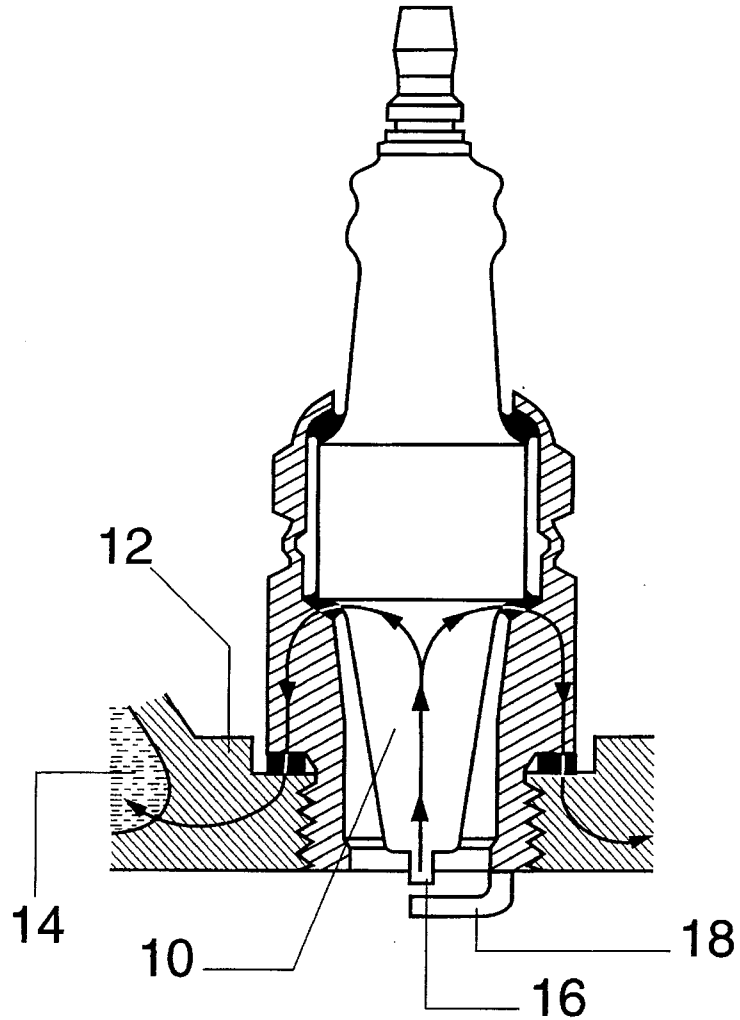
FIG.2 Prior Art
FIG. 2 is a side view, partially in cross-section, of a hot-running spark plug.
Figure 1:
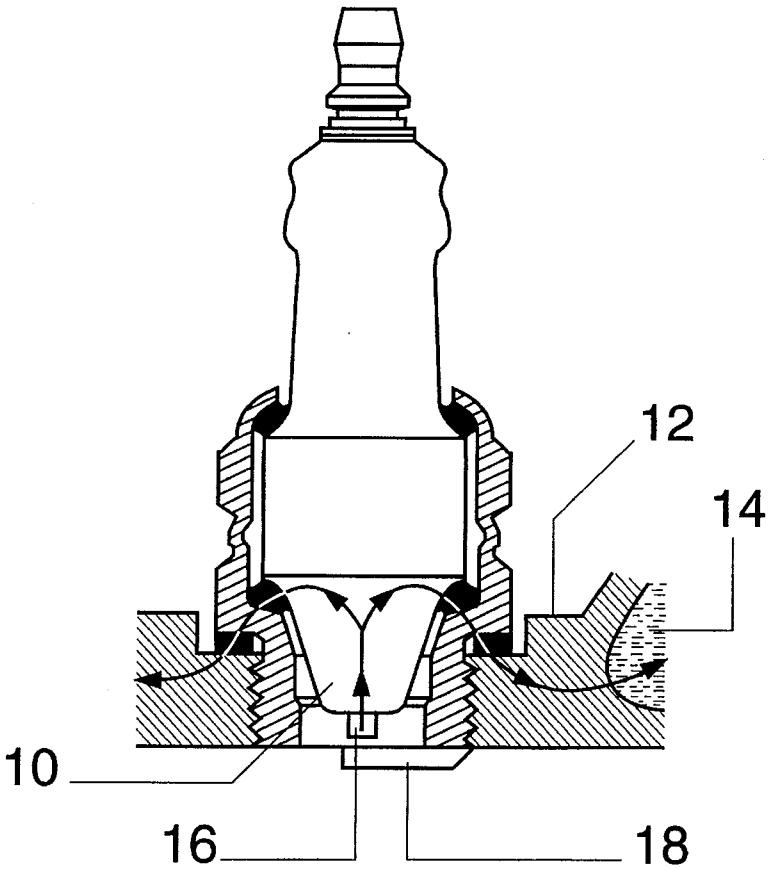
FIG.1 Prior Art
FIG. 1 is a side view, partially in cross-section, of a cold-running spark plug.
Figure 3:
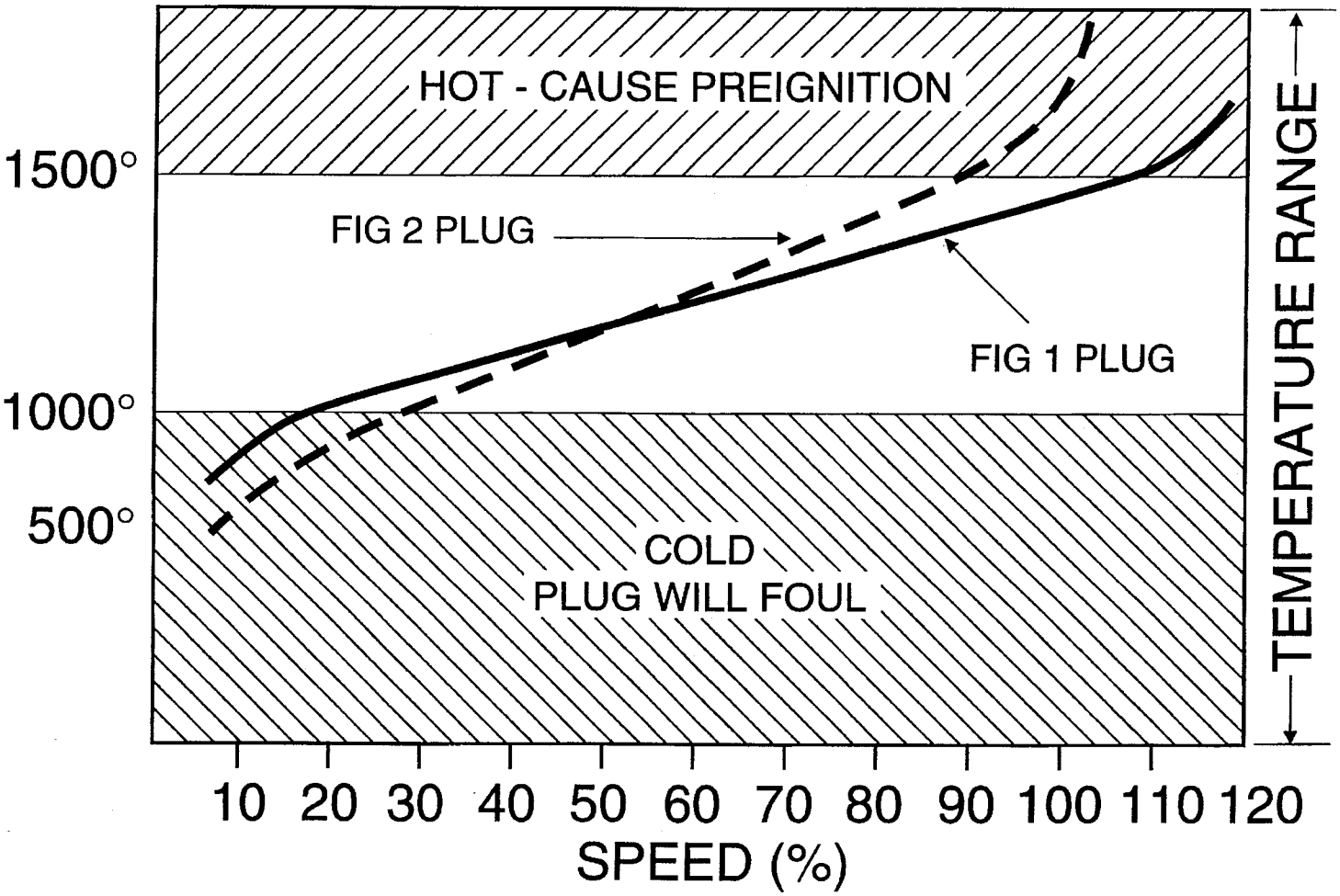
FIG. 3 Prior Art
FIG. 3 is a graph of spark electrode tip temperature vs. engine speed for the spark plugs of FIGS. 1 and 2.

By replacing the center nickel-steel or platinum tip of a spark plug with one exhibiting a negative electron affinity (NEA) such as AlN, two major advantages accrue. First, the tip no longer must be operated at a high temperature to avoid fouling as it will readily emit electrons at high density even when cold. This is of particular advantage in starting a cold engine. Under such conditions, the conventional spark plug operates in a manner similar to a field emitter. Only after the engine is started and the spark plug tip is hot does it operate as a thermionic emitter. In fact, the NEA tipped spark plug will emit a greater electron density than does a conventional center tip operating at 1500 degrees Fahrenheit. The insulator can be very short—even shorter than that of the coldest of conventional spark plugs shown in FIG.1. This attribute has several secondary advantages. Among them are that one heat range serves all applications, thus greatly reducing inventory costs and lowering production cost. Another advantage is that the cooler center electrode tip will erode at a much lower rate as the erosion is exponentially proportional to temperature. The second major advantage of the NEA electrode tip is that the spark gap can be made much longer without reducing the probability of a spark occurring. This advantage derives from the fact that it requires but 0.00001 the electric field strength of a field emitter to emit a given current density. This advantage is particularly relevant when the cold engine is being initially started. As the conventional spark plug tip warms up, it is no longer a conventional field emitter, but a thermionic emitter and the NEA advantage drops to about a factor of 50. Even then, the spark plug gap can be more than doubled, thus providing reduced tip erosion/burning and greater probability of igniting the fuel/air mixture.

Figure 5:
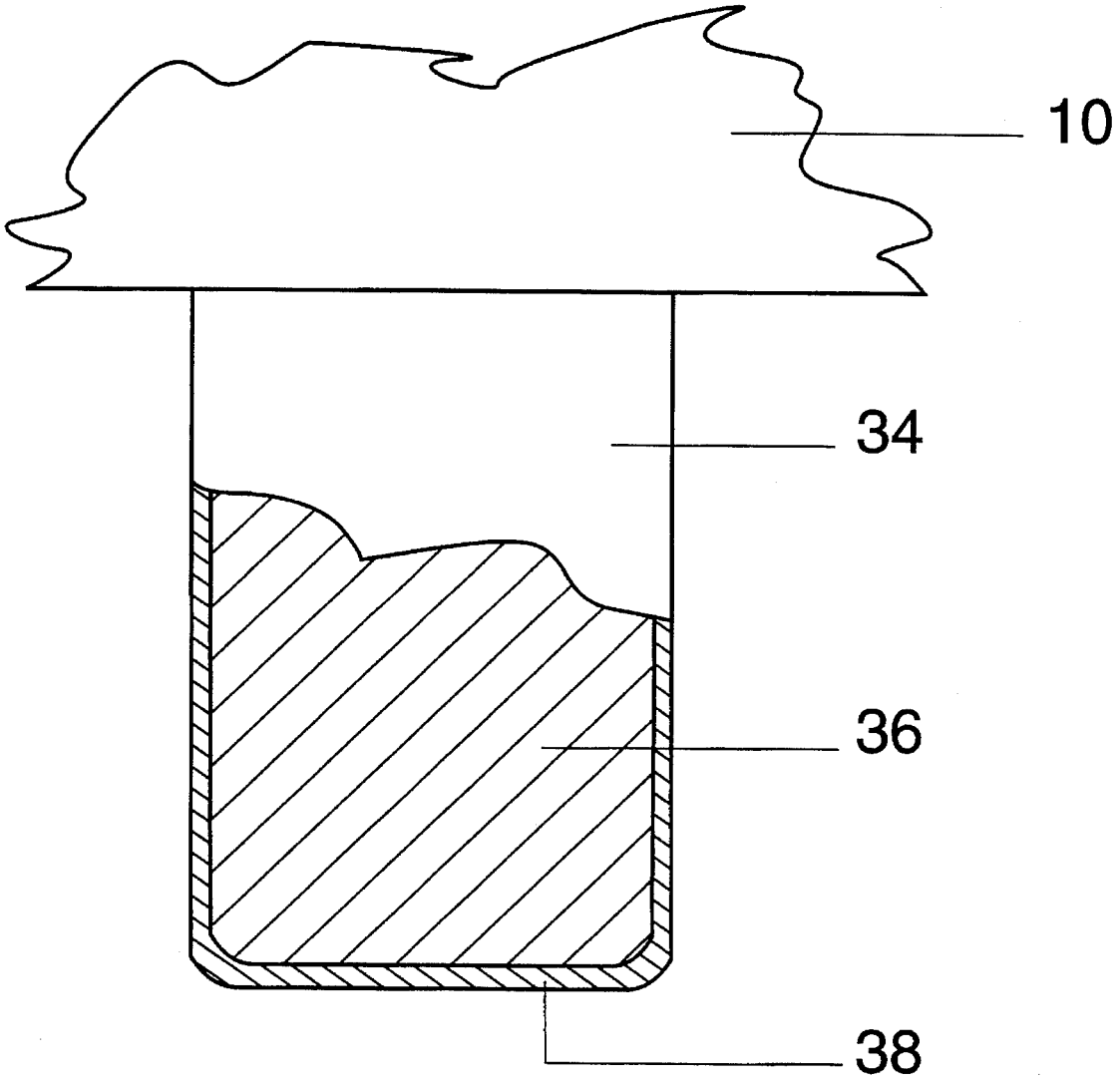
FIG. 5 is a cross-section view of an NEA spark electrode tip, according to the invention.

Referring to FIG. 5, in one embodiment of the invention, the "core" portion 36 of the spark electrode tip 34 is formed of aluminum or aluminum alloy which is doped with chlorine and silicon, and the surface of the spark electrode tip facing the ground electrode 24 is covered by a layer 38 of n-type (silicon doped) aluminum nitride which is less than 20 nanometers thick.

During operation of the internal combustion engine, exposure of the A1N layer 38 to oxygen in the combustion chamber will eventually convert this layer to sapphire (aluminum oxide, $Al_2O_3$), which is also a NEA material. Because of the extreme thinness of the layer 38, now aluminum oxide, electrons can tunnel through it to the surface where they are emitted into the spark gap. Thereafter, during further operation of the engine, as the oxygen of the combustion chamber causes the aluminum core 36 to slowly oxidize and form aluminum oxide, the silicon and chlorine impurities in the forming aluminum oxide create a low electrical resistance path to pass electrons to the aluminum oxide surface where they are emitted to generate the spark.

In another embodiment of the invention, the layer 38 covering the silicon and chlorine doped aluminum core 36 is formed of aluminum oxide rather than aluminum nitride. Also, other NEA materials may be used to form the layer 38, such as n-type alloys of GaAlN where the bandgap exceeds 5.5 eV.

Also the core portion 36 of the spark electrode tip 34 may be formed of other electrically conductive materials, such as the nickel steel alloys presently used in many spark plugs.

In view of the many variations, additions, and changes to the embodiments of the invention specifically described therein, which would be obvious to one skilled in the art, it is intended that the scope of the invention be limited only by the appended claims.

What is claimed and Desired to be Secured by Letters Patent of the United States is:

1. A spark plug having a negative electrode and a positive electrode, the two electrodes having respective, spaced apart, spark end portions which define a spark path therebetween, the spark end portion of the negative electrode comprising an n-type impurity-doped semiconductor material exhibiting negative electron affinity (NEA).

2. A spark plug, as described in claim 1, wherein said semiconductor material has very large chemical binding energies such that hydrogen carbon and nitrogen will not bind or chemisorb to its surface.

3. A spark plug, as described in claim 1, wherein said semiconductor material comprises cubic boron nitride (cBN).

4. A spark plug, as described in claim 1, wherein said semiconductor material comprises aluminum nitride (AlN).

5. A spark plug having a negative electrode and a positive electrode, the two electrodes having respective, spaced apart, spark end portions which define a spark path therebetween, the spark end portion of the negative electrode comprising a thin surface film, 1–20 nanometers thick, of an NEA material, I.e., a material exhibiting negative electron affinity.

6. A spark plug, as described in claim 5, wherein said NEA material has very large chemical binding energies such that hydrogen carbon and nitrogen will not bind or chemisorb to its surface.

7. A spark plug, as described in claim 5, wherein said surface film comprises sapphire ($Al_2O_3$).

8. A spark plug, as described in claim 5, wherein said surface film comprises n-type impurity-doped aluminum nitride (AlN).

9. A spark plug, as described in claim 5, wherein said surface film comprises an n-type alloy of gallium aluminum nitride (GaAlN) having a bandgap exceeding 5.5 eV.

10. A spark plug, as described in claim 5, wherein the spark end portion of the negative electrode comprises an inner portion on which said thin surface film is formed, said inner portion comprising aluminum doped with at least one dopant, selected so that when the aluminum adjacent the thin surface film is slowly oxidized to form aluminum oxide, the at least one dopant creates a low electrical resistance path through the forming aluminum oxide to the thin surface film of NEA material.

11. A spark plug, as described in claim 10, wherein the at least one dopant comprises silicon and chlorine.

12. A spark plug, as described in claim 10, wherein the at least one dopant comprises silicon or chlorine.

* * * * *